US008941508B2

(12) United States Patent
Pfannenberg

(10) Patent No.: US 8,941,508 B2
(45) Date of Patent: Jan. 27, 2015

(54) SIGNALING DEVICE FOR EMITTING AN ACOUSTIC AND/OR VISUAL SIGNAL

(71) Applicant: Andreas Pfannenberg, Hamburg (DE)

(72) Inventor: Andreas Pfannenberg, Hamburg (DE)

(73) Assignee: Pfannenberg GmbH, Hamburg (DE)

( * ) Notice: Subject to any disclaimer, the term of this patent is extended or adjusted under 35 U.S.C. 154(b) by 63 days.

(21) Appl. No.: 13/682,975

(22) Filed: Nov. 21, 2012

(65) Prior Publication Data

US 2013/0127629 A1 May 23, 2013

(30) Foreign Application Priority Data

Nov. 22, 2011 (DE) ..... 10 2011 055 592

(51) Int. Cl.
*G08B 5/00* (2006.01)
*G08B 7/06* (2006.01)
*G08B 5/36* (2006.01)

(52) U.S. Cl.
CPC .... *G08B 7/06* (2013.01); *G08B 5/36* (2013.01)
USPC ..... 340/815.4; 340/286.11; 340/332; 340/691.1

(58) Field of Classification Search
USPC ..... 340/815.4, 693.5, 691.1, 692, 286.02, 340/286.11, 332
See application file for complete search history.

(56) References Cited

U.S. PATENT DOCUMENTS

| | | | | |
|---|---|---|---|---|
| 4,904,982 | A * | 2/1990 | Lieb et al. | 340/326 |
| 5,132,659 | A * | 7/1992 | Kuo | 340/326 |
| 5,825,280 | A * | 10/1998 | Merendini et al. | 340/326 |
| 7,135,960 | B2 * | 11/2006 | Arcaria et al. | 340/384.1 |
| 7,920,069 | B2 * | 4/2011 | Shain et al. | 340/815.4 |

FOREIGN PATENT DOCUMENTS

WO 2008045692 A2 4/2008

* cited by examiner

*Primary Examiner* — Toan N Pham
(74) *Attorney, Agent, or Firm* — McCormick, Paulding & Huber LLP

(57) ABSTRACT

A signaling device for emitting an acoustic and/or visual signal includes a base housing body, and an upper housing part. The upper housing part can be connected to the base housing to form a receiving space, in which at least one electrical component assembly for generating signals is disposed and from which at least a first electrical line can be guided into the signaling device. A line connection mechanism is provided and disposed in the base housing body to which the electrical line can be connected. The electrical component assembly for the signal generation is disposed on the upper housing part.

15 Claims, 4 Drawing Sheets

SIGNALING DEVICE FOR EMITTING AN ACOUSTIC AND/OR VISUAL SIGNAL

CROSS REFERENCE TO RELATED APPLICATION

This application claims the benefit of German Patent Application No. 102011055592.7, filed Nov. 22, 2011, entitled "SIGNALING DEVICE FOR EMITTING AN ACOUSTIC AND/OR VISUAL SIGNAL", herein incorporated by reference in its entirety.

DESCRIPTION

The present invention relates to a signaling device for emitting an acoustic and/or visual signal, comprising a base housing body, which is embodied in one piece, and an upper housing part, wherein the upper housing part can be connected to the base housing body, and wherein a receiving space, in which at least one electrical component assembly is disposed for generating signals, is formed by means of the base housing body and the upper housing part, and wherein at least a first electrical line can be guided into the signaling device.

STATE OF THE ART

Signaling devices are known for emitting an acoustic and/or visual signal and are often installed in buildings as safety engineering component. Signaling devices can furthermore be used for production plants, for machines or for electrical devices, so that the signaling devices can be arranged on different accommodating bodies. For example, signaling devices can be arranged on a wall in an on-wall mounting or in an in-wall mounting. It is also possible that signaling devices are arranged in the housing of an electrical device, and the signaling devices can send acoustic and/or visual signals, for example for signaling an emergency situation, a malfunction situation or the like.

When the signaling device is assembled on an accommodating body, the base housing body can initially be arranged on the accommodating body. The base housing body can be screwed onto the accommodating body, for example. Simultaneously, an electrical line can be inserted into the receiving space in the signaling device, so that the signaling device is connected to building services, for example, or to another circuitry, for example. The need to connect the electrical component assembly for the signal generation to the electrical line arises thereby. In the event that an assembler must establish the electrical connection, it could happen that the assembler must hold the electrical component assembly as well as the electrical line, whereby a tool, for example a screwdriver, must be handled at the same time. Even though the electrical component assembly can be disposed in the base housing body, the arrangement of an acoustic signaler in the upper housing part is necessary, so that the disadvantage of an additional cabling is furthermore created, which, in turn, is associated with disadvantages in the handling. In the event that the electrical component assembly is disposed completely in the upper housing part, and in the event that the electrical line is inserted into the base housing body, the disadvantage of the poor ease of assembly is created, in turn.

In the assembly of signaling devices, for example in a building, it could happen that a plurality of signaling devices must be assembled. A simple assembly of the signaling devices on the accommodating body, which can be carried out quickly, and a simple and quick establishing of the electrical connection of the signaling device via the electrical line are thus particularly desirable.

DISCLOSURE OF THE INVENTION

It is thus the object of the present invention to provide for a signaling device for emitting an acoustic and/or visual signal, which can be assembled easily and which can be connected electrically in a simple manner.

A line connection means is provided and disposed in the base housing body, which is embodied in one piece and to which the first electrical line can be connected, wherein the electrical component assembly for the signal generation is disposed on the upper housing part.

The invention proposes the advantageous possibility of a line connection means, which is disposed in the base housing body, and the electrical line can be connected to the line connection means independent from the upper housing part and independent from the electrical component assembly. An assembler can initially dispose the base housing body on the accommodating body, and the electrical connection can be established without the upper housing part and in particular without the electrical component assembly. Only the electrical connection between the electrical line and the line connection means is established thereby. The upper housing part comprising the electrical component assembly for the signal generation can subsequently be disposed on the base housing body.

Unless otherwise specified, a base housing body will always be understood hereinbelow as a base housing body, which is embodied in one piece.

In another aspect of the invention between the line connection means and the electrical component assembly for the signal generation at least one contacting means is provided. The contacting means can comprise a first plug-in contact partner and a second plug-in contact partner, and the plug-in contact partners can be connected to one another by disposing the upper housing part on the base housing body. The first plug-in contact partner can be disposed on the base housing body and in particular on the line connection means itself, and the second plug-in contact partner can be disposed on the upper housing part and in particular on the electrical component assembly itself. In particular in the case of signaling devices, the arrangement of the electrical component assembly in the upper housing part is advantageous, because the electrical component assembly can comprise an audio signal generating means, which is disposed in the upper housing part in structural unity with an electronic component. The audio signal generating means, for example a loudspeaker, can be disposed in the upper housing part and can comprise an acoustic horn, via which the acoustic signal leaves the signaling device. In the event that the upper housing part is removed from the base housing body, the upper housing part can comprise the electrical component assembly comprising the electronic component and comprising the loudspeaker. In the event that the upper housing part is disposed on the base housing body, the contacting means is closed by means of the plug-in contact partner on the upper housing part and on the base housing body. It is advantageous, in particular, that work can be carried out on the electrical component assembly, without the electrical component assembly being energized, because the electrical component assembly can only be accessed, when the upper housing part comprising the electrical component assembly is separated from the base housing body and thus from the line connection means.

In another aspect, the base housing body comprises at least two housing apertures, wherein a first electrical line can be guided through a first housing aperture and a second electrical line can be guided through a second housing aperture. The base housing body can initially be fastened to the accommodating body, for example to a wall in an on-wall mounting or in an in-wall mounting. With this, the base housing body is already arranged in a fixed manner and must no longer be held by an assembler. The housing apertures can be prepared in the base housing body as break-out openings, which can be broken out of the housing walls manually or by means of a tool, so as to guide the electrical line through the housing apertures. It is also possible that the housing apertures comprise means for sealing the electrical line, for example in the form of rubber squeeze-type gaskets. The base housing body can comprise only one housing aperture, so as to already introduce an electrical line into the receiving space of the base housing body with it. In the event that a plurality of signaling devices are interconnected successively, at least a second housing aperture can be provided, through which at least one further electrical line can be guided.

In another aspect, when the line connection means comprises a contact strip, and in particular the first electrical line and preferably a second electrical line can be connected electrically to the contact strip. The contact strip can comprise connecting contacts, on which individual lines of the first electrical line and in particular of the second electrical line can be disposed, wherein in particular connecting contacts for connecting the individual lines of the first electrical line and connecting contacts for connecting the individual lines of the second electrical line can be wired identically. For example, the contact strip can comprise screw connection terminals, and screw connection terminals, which are provided adjacent to one another, can in each case connect individual lines of the first and of the second electrical line to one another. The electrical contacting of the individual lines to the electrical component assembly takes place at the same time.

In the event that the signaling device is embodied for assembly to an accommodating body, at least one moulding and at least one recess can be formed on the base housing body, so that the moulding of a first signaling device can be inserted into the recess of an adjacent second signaling device in a manner of a positive fit in response to an adjacent assembly of at least two signaling devices on the accommodating body. For example, the base housing body can comprise a recess and a moulding on a wall, and in the event that two signaling devices are arranged adjacent to one another, a positive fit connection between the signaling devices is established in two positions.

The base housing body can comprise a housing bottom, on which the housing walls preferably extend in a substantially rectangular housing form, so that the base housing body in abstract form forms a cube. In the corner areas, the housing form can comprise hollow chambers, which extend outwardly in the corners on the housing walls. The hollow chambers can be freely accessible from the bottom side of the base housing body, whereby an advantageous die casting mould is formed for producing the base housing body from a plastic.

Fastening links, which preferably extend in the plane of the housing bottom between the hollow chambers, can be disposed on the outer side of the base housing body, wherein at least one hole is placed into the fastening links. Intermediate areas, in which the fastening links are clamped, are created by means of the formation of the hollow chambers, which protrude outwardly. The fastening links can thus merge into the base housing body in one piece on three side edges, whereby an increased stability of the fastening links is formed. Fastening elements, which can be embodied in the form of screws, nails or other bolts, for example, can be guided through the holes in the fastening links. For example, the fastening links on the outer side can be integrally moulded on two housing walls located opposite one another, and the moldings and recesses for forming the positive connection between two signaling devices can be disposed on two further housing walls located opposite one another.

In another aspect, perforations can be placed into the housing bottom, wherein the perforations can optionally be removed so as to form holes, and wherein the perforations are formed by means of predetermined breaking points, which can be removed without damaging the base housing body. In the event that holes are created in the housing body by removing the perforations, fastening means can be guided through the holes so as to fasten the signaling device on an accommodating body.

The signaling device can be embodied for the combined emitting of acoustic and visual signals, wherein the signaling device can also send acoustic signals only or visual signals only. In the event that the signaling device is embodied for emitting visual or visual and acoustic signals, the signaling device can comprise a lighting unit, which is preferably disposed on the base housing body and which is electrically connected to the line connection means, for example. The lighting unit can comprise an illuminant, which is disposed underneath a light-permeable cover of the lighting unit. The lighting unit can be electrically connected to the line connection means in an already pre-assembled manner, before an assembler assembles the signaling device. In a particularly advantageous manner, the signaling device can be disposed on a vertical accommodating body, for example on a wall, such that the lighting unit is oriented upwardly, whereby the visual signaling effect of the lighting unit is improved further.

In another aspect, which improves the signaling device, a guide arrangement can be provided, by means of which the upper housing part is guided when joining the upper housing part to the base housing body. The guide arrangement can comprise at least one guide spring and at least one guide groove, wherein the guide spring is inserted into the assigned guide groove by joining the upper housing part to the base housing body. For example, four guide springs, which form a rectangle and which engage with four guide grooves on the upper housing part, which also form a rectangle, can be disposed on the base housing body, when the upper housing part is joined to the base housing body.

In another aspect, the guide arrangement comprises a plurality of guide springs and a plurality of guide grooves, which are respectively assigned to each other, wherein at least one guide spring comprising a differing geometry is assigned to at least one guide groove comprising a correspondingly differing geometry, so that the upper housing part can be disposed on the base housing body only when the guide spring comprising the differing geometry is joined with the guide groove comprising the likewise differing geometry. It can be prevented thereby that an assembler assembles the upper housing part on the base housing body in an unsuitable position. The guide spring and the assigned guide groove in each case comprising a differing geometry interact as centring means, which has the effect that upper housing part and base housing body can always be joined together only in a predetermined position. On principle, however, the centring means can also comprise any other suitable form or embodiment, respectively. In the alternative, the centring means can comprise a centring lug on one of the two components, upper housing part and base housing body, and a corresponding centring lug accommodation on the other component, for example.

In another aspect the upper housing part can be connected to the base housing body by means of connection elements, wherein the connection elements can preferably be inserted into openings, which are placed in particular into hollow chambers. The hollow chambers can be provided in the corner areas of the housing, for example, and can extend outwardly in the corners on the housing walls. The hollow chambers can be freely accessible from the bottom side of the base housing body.

For example, the base housing body can have a depth of between 40 mm and 150 mm, preferably between 45 mm and 140 mm, and particularly preferably between 47 mm and 125 mm. The upper housing part can furthermore have a depth of between 20 mm and 75 mm, preferably between 30 mm and 60 mm, and particularly preferably between 32.5 mm and 56 mm. In the assembled state on the base housing body, the upper housing part can project into the base housing body, so that the total depth of the signaling device does not necessarily follow from the sum of the depths of the base housing body and the upper housing part. A ratio of the depth of the base housing body to the upper housing part of between 1.0 and 4.4, preferably between 1.4 and 4.1, and particularly preferably between 1.45 and 3.0 follows.

PREFERRED EMBODIMENT OF THE INVENTION

Further measures, which improve the invention, will be illustrated below in more detail together with the description of a preferred embodiment of the invention by means of the figures. Schematically, FIG. 1 shows a schematic view of a signaling device;

Figure 1:
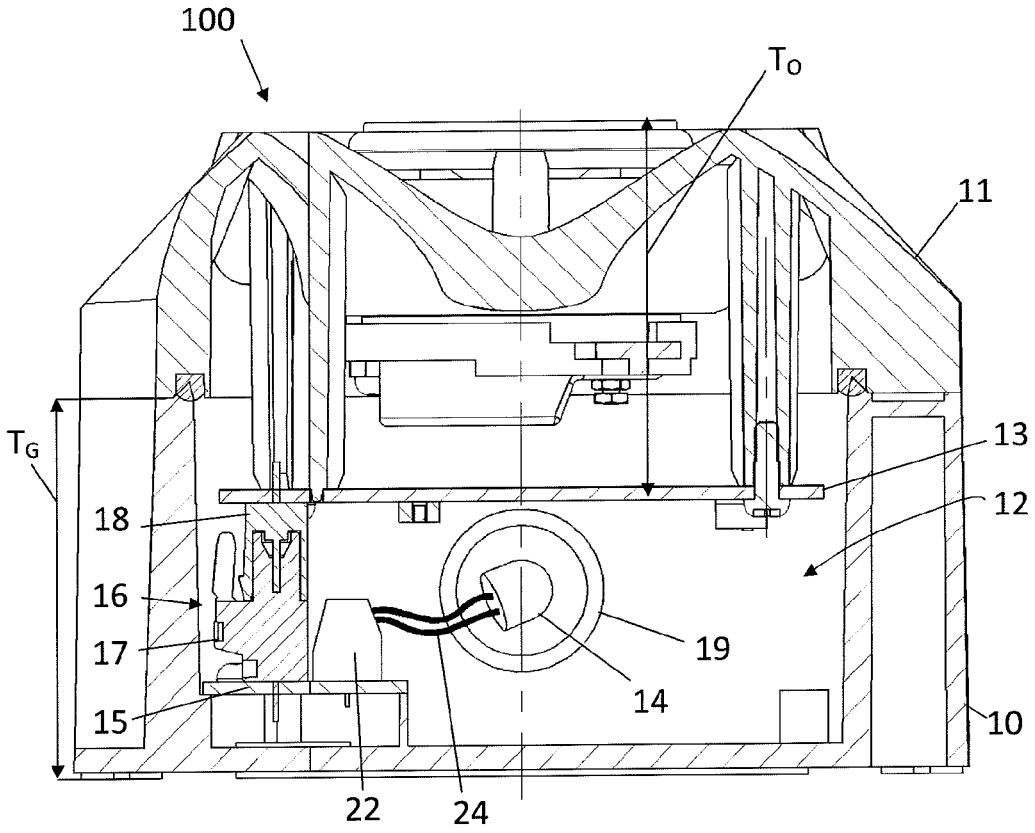

FIG. 1 shows a schematic view of a signaling device 100 for emitting an acoustic and/or visual signal. The housing of the signaling device is formed substantially by means of a base housing body 10 and an upper housing part 11. The upper housing part 11 can be removed from the base housing body 10, wherein a closed receiving space 12 is formed with the base housing body 10 and the upper housing part 11. An electrical component assembly 13, which can comprise electronic components and which serve for the acoustic and/or visual signal generation, is shown in the receiving space 12. In particular, the electrical component assembly 13 can comprise a sound generator, by means of which acoustic signals can be generated.

A housing aperture 19, which is located in a side wall of the base housing body 10, is placed into the base housing body 10. A first electrical line 14, which comprises individual lines 24, is guided through the housing aperture 19, and the individual lines 24 are connected to a contact strip 22 of a line connection means 15. The line connection means 15 is located in the base housing body 10 of the signaling device 100.

A contacting means 16 is disposed between the electrical component assembly 13, which is disposed in the upper housing part 11, and the line connection means 15, which is disposed in the base housing body 10. The contacting means 16 is embodied as a contact plug and comprises a first plug-in contact partner 17 and a second plug-in contact partner 18. The first plug-in contact partner 17 is connected to the line connection means 15 in an exemplary manner, or is disposed thereon, respectively, and the second plug-in contact partner 18 is connected to the electrical component assembly 13 or is disposed thereon, respectively. In the event that the upper housing part 11 comprising the electrical component assembly 13 is separated from the base housing body 10, the first plug-in contact partner 17 is also separated from the second plug-in contact partner 18.

In the assembly of the signaling device 100, the base housing body 10 can initially be fastened to an accommodating body. The electrical line 14 can subsequently be guided through the housing aperture 19, and the individual lines 24 can be connected to the contact strip 22 of the line connection means 15. An excellent accessibility of the contact strip 22 is thereby possible, which can comprise screws, for example, so as to clamp the individual lines 24. Once the fastening of the individual lines 24 to the contact strip 22 has taken place, the upper housing part 11 can be placed onto the base housing body 10, wherein the plug-in contact partners 17 and 18 are simultaneously connected to one another. A particularly simple assembly possibility is created for the signaling device 100 by means of the advantageous division of the electrical component assembly 13 in the upper housing part 11 and of the line connection means 15 in the base housing body 10.

The depth of the base housing body 10 is specified with $T_G$ and the depth of the upper housing part 11 is specified with $T_O$. The housing of the signaling device 100 forms the shape of a cube, for example, wherein the cube does not need to have the same edge lengths.

Figure 2:
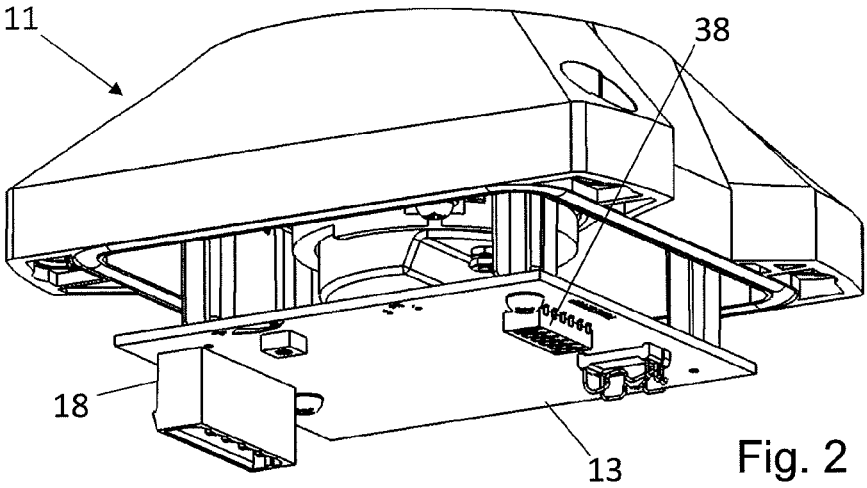
FIG. 2 shows a perspective view of an upper housing part comprising an electrical component assembly.

The upper housing part 11 is illustrated in a perspective view in FIG. 2, and the electrical component assembly 13 is attached to the inner side of the upper housing part 11. The electrical component assembly 13 is embodied in an exemplary manner as electronic board and comprises an adjusting means 38, for example, by means of which the acoustic audio signal can be adjusted. In the event that the upper housing part 11 has been removed from the base housing body 10 according to the illustration, the adjusting means 38 is freely accessible for an operator. A plug-in contact partner 18 is furthermore disposed on the electrical component assembly 13, and the contacting means 16 can be formed with the plug-in contact partner 18 when the upper housing part 11 is disposed on the base housing body 10.

Figure 3:
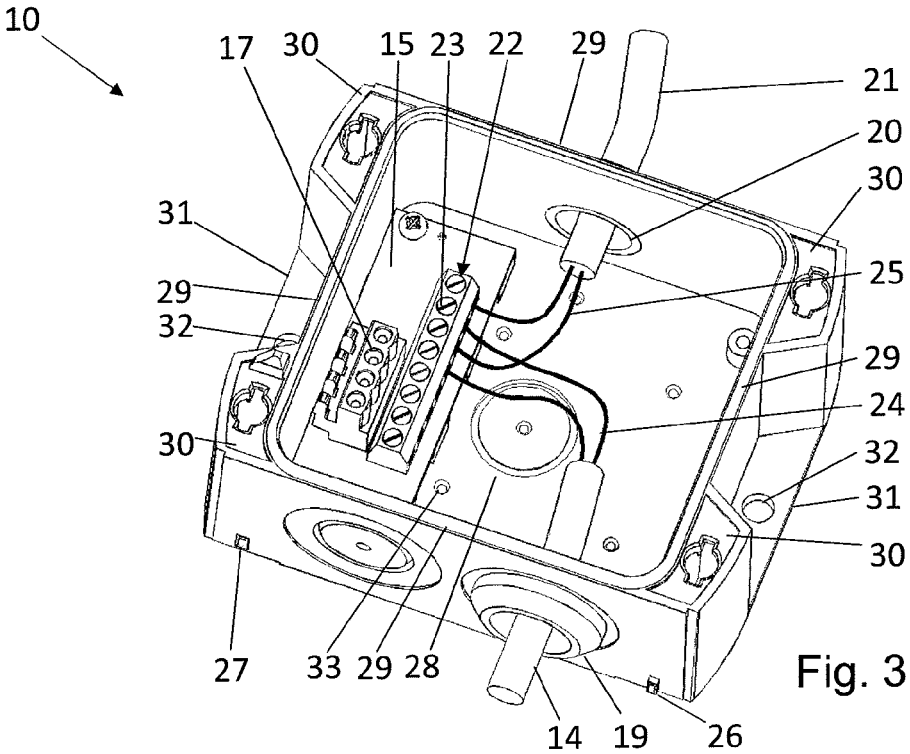
FIG. 3 shows a perspective view of a base housing body comprising a line connection means.

FIG. 3 shows the base housing body 10 in a perspective view. The line connection means 15 is disposed in the base housing body 10. A plug-in contact partner 17 is shown on the line connection means 15. When the upper housing part 11 is placed onto the base housing body 10, the plug-in contact partner 18 can be connected to the plug-in contact partner 17. For this purpose, the position of the two plug-in contact partners 17 and 18 corresponds in such a manner that the plug-in contact partner 17 is inserted accurately into the plug-in contact partner 18 when the upper housing part 11 is placed onto the base housing body 10.

The base housing body 10 comprises housing apertures 19 and 20, and the electrical line 14 is guided through the housing aperture 19, and the electrical line 21 is guided through the housing aperture 20. Two electrical lines 14 and 21 are guided into the base housing body 10 in an exemplary manner, wherein the electrical line 21 can lead to a further signaling device 100, for example.

The individual lines 24 of the electrical line 14 and the individual lines 25 of the electrical line 21 are disposed on a contact strip 22, which has connecting contacts 23. Two adjacent connecting contacts 23 can thereby be wired identically in each case and can be electrically connected to one another, so that the individual lines 24 are in each case also electrically connected to the individual lines 25. The electrical line 14 can thus be interconnected to the electrical line 21, for example when a plurality of signaling devices 100 are arranged successively and are electrically interconnected in parallel.

The base housing body 10 comprises a housing bottom 28, into which perforations 33 are placed. The perforations 33 can be broken through, so as to guide fastening means, such as screws, etc., through the formed holes of the perforations 33, and so as to fasten the signaling device 100 to an accommodating body.

Fastening links 31, which extend between hollow chamber 30, which are disposed in the corner areas on the outside of the base housing body 10, are furthermore located on the outer side of the base housing body 10. The fastening links 31 attain an increased stability through this. Holes 32, through which fastening elements can also be guided, are placed into the fastening links 31. The base housing body 10 is made in one piece of a plastic die casting mould component, and four housing walls 29, by means of which the base housing body 10 obtains an approximately rectangular shape, are moulded on the housing bottom 28.

The fastening links 31 are located on two housing walls 29 on the bottom side disposed opposite from one another, and the housing apertures 19 and 20 are placed into two further housing walls 29, which extend diagonally thereto. The housing apertures 19 and 20 can also be prepared as perforations and must only be removed when electrical lines 14 and 21 must indeed be inserted into the base housing body 10. Moldings 26 and recesses 27 are furthermore located on the housing walls 29, into which the housing apertures 19 and 20 are placed, and moldings 26 of a first signaling device can engage with the recesses 27 of a further signaling device 100 when a plurality of signaling devices 100 are arranged adjacent to one another.

Figure 4:
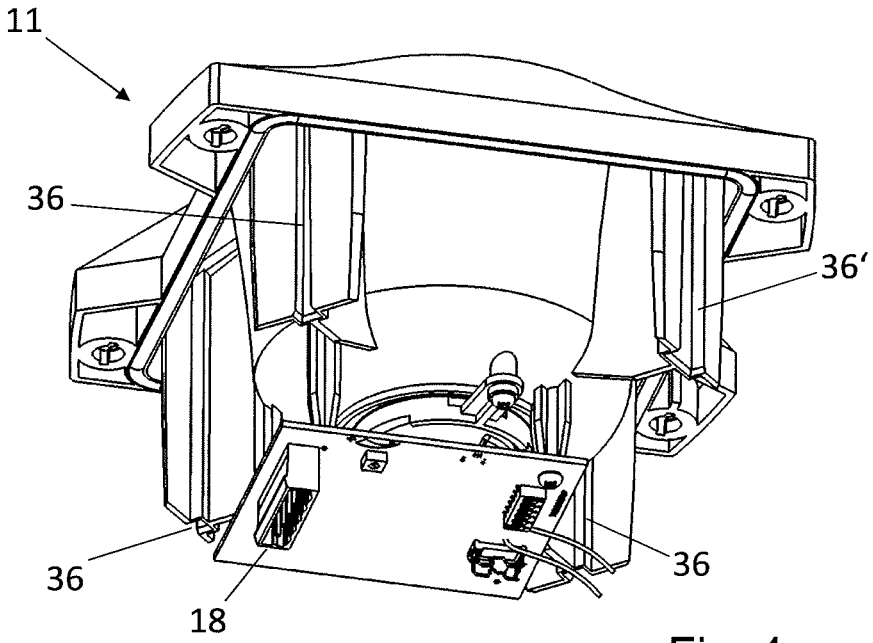
FIG. 4 shows an embodiment of an upper housing part comprising guide grooves.
Figure 5:
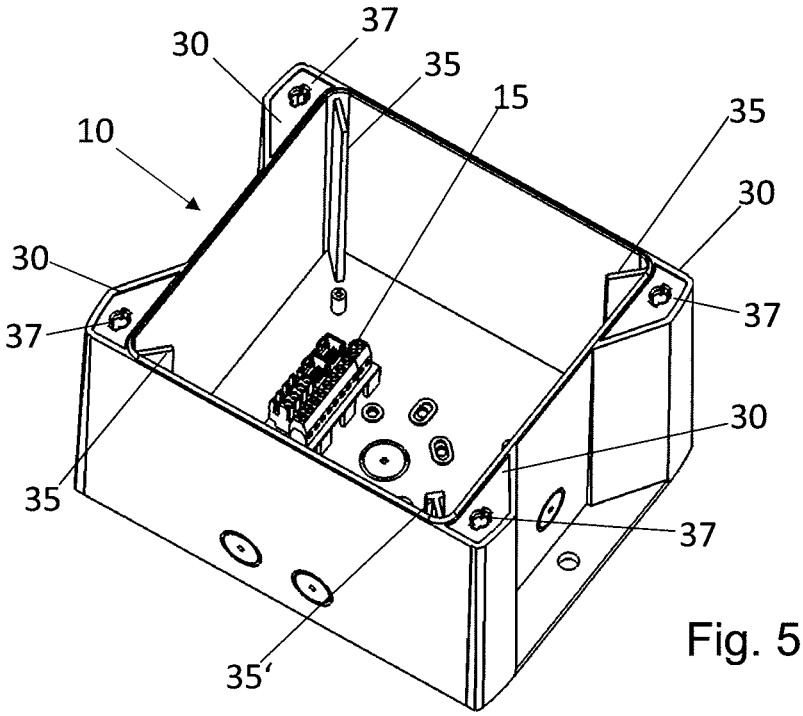
FIG. 5 shows an embodiment of a base housing body comprising guide springs, which form a guide arrangement together with the guide grooves in the upper housing part.

FIGS. 4 and 5 show the upper housing part 11 and the base housing body 10 in each case in a perspective view. Guide grooves 36, which extend along an assembly direction when the upper housing part 11 is assembled with the base housing body 10, are disposed on the upper housing part 11. Guide springs 35, which correspond to the guide grooves 36 and which engage with the guide grooves 36 when joining the upper housing part 11 to the base housing body 10, are disposed on the base housing body 10. It is shown that a guide groove 36' comprises a differing geometry, which must correspond to a differing geometry of a guide spring 35', so that the upper housing part 11 can be assembled to the base housing body 10. It is ensured with this that the upper housing part 11 is assembled in a correct position with the base housing body 10, for example when the plug-in contact partner 17 on the base housing body 10 must be joined to the plug-in contact partner 18 on the upper housing part 11, so as to create an electrical connection of the electrical component assembly 13 with a line connection means 15, for example.

Figure 6:
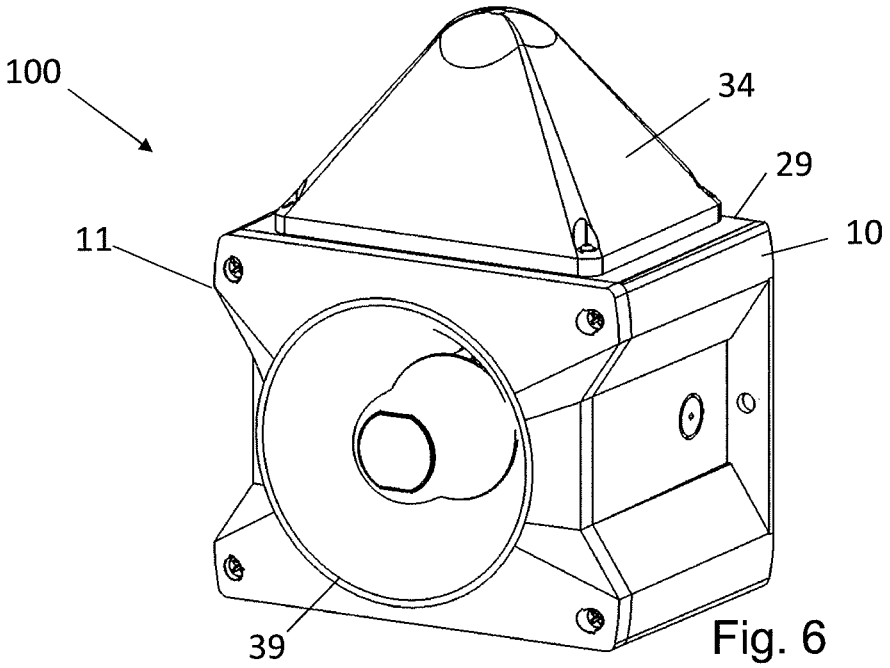
FIG. 6 shows a perspective view of a signaling device comprising a lighting unit.
Figure 7:
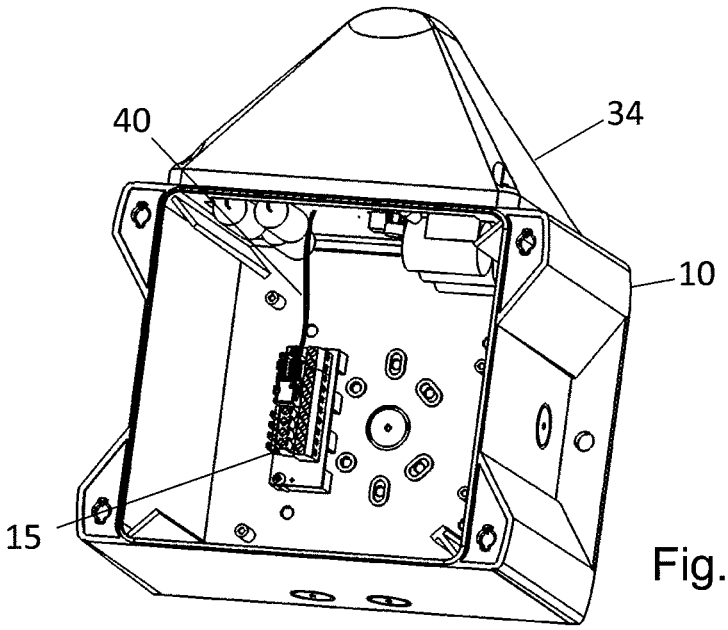
FIG. 7 shows a perspective view of a base housing body comprising a lighting unit.

FIGS. 6 and 7 show a signaling device 100 comprising an audio signal generator 39, which is disposed on the front side of the upper housing part 11 and which comprises an acoustic horn, and the signaling device 100 furthermore comprises a lighting unit 34, which is disposed on a housing wall 29 of the base housing body 10. The lighting unit 34 has a transparent cover, which extends with a base area approximately across the entire outer surface of the housing wall 29. A large surface of the cover of the lighting unit is accomplished with this, so as to provide for a good heat dissipation. The signaling device 100 is shown in a preferred position, in which the lighting unit 34 points upwards, whereby the signaling effect of the lighting unit 34 is improved. The audio signal generator 39 comprises an acoustic horn, which leads into the signal generating means on the inner side, which can be disposed on the electrical component assembly 13. FIG. 7 shows a perspective view of the base housing body 10 comprising the line connection means 15. Electrical connections can be formed between the lighting unit 34 and the line connection means 15. In the event that the signaling device 100 is provided for assembly, the electrical connections can already be present.

The invention is not limited to the above-specified preferred embodiment. Instead, a number of alternatives is possible, which uses the illustrated solution even in the case of embodiments, which are different on principle. All of the features and/or advantages, which follow from the claims, the description or from the drawings, including structural details, spatial arrangements and method steps, can be significant for the invention, either alone as well as in a variety of combinations.

What is claimed is:

1. A signaling device for emitting an acoustic and/or visual signal, comprising a base housing body, which is embodied in one piece, and an upper housing part, wherein the upper housing part can be connected to the base housing body, and wherein a receiving space, in which at least one electrical component assembly for generating signals and signal generating means for emitting an acoustic and/or visual signal are disposed, is formed by the base housing body and the upper housing part, and wherein at least a first electrical line can be guided into the signaling device, wherein a line connection means is provided and disposed in the base housing body, wherein the first electrical line can be connected to the line connection means, wherein the electrical component assembly for the signal generation and the signal generating means for emitting an acoustic and/or visual signal are disposed on and fixed to the upper housing part.

2. The signaling device according to claim 1, wherein at least one contacting means is provided between the line connection means and the electrical component assembly for the signal generation.

3. The signaling device according to claim 2, wherein the contacting means comprises a first plug-in contact partner and a second plug-in contact partner, which can be connected to one another by disposing the upper housing part on the base housing body, wherein the first plug-in contact partner is disposed on the base housing body and in particular on the line connection means and wherein the second plug-in contact partner is disposed on the upper housing part and in particular on the electrical component assembly.

4. The signaling device according to claim 1, wherein the base housing body comprises at least two housing apertures, wherein the first electrical line can be guided through a first housing aperture and a second electrical line can be guided through a second housing aperture.

5. The signaling device according to claim 1, wherein the line connection means comprises a contact strip, and in particular the first electrical line and preferably a second electrical line can be connected electrically to the contact strip.

6. The signaling device according to claim 5, wherein the contact strip comprises connecting contacts, to which individual lines of the first electrical line and in particular of the second electrical line can be contacted, wherein in particular connecting contacts for connecting the individual lines of the first electrical line and connecting contacts for connecting the individual lines of the second electrical line are wired identically, more particularly, wherein connecting contacts connect individual lines of the first electrical line and the second electrical line to one another.

7. The signaling device according to claim 1, wherein the base housing body is embodied for assembly to an accommodating body, wherein at least one molding and at least one recess are formed on the base housing body, so that the molding of a first signaling device can be inserted into the recess of an adjacent second signaling device in a manner of a positive fit in the event of an adjacent assembly of at least two signaling devices on the accommodating body.

8. The signaling device according to claim 1, wherein the base housing body comprises a housing bottom, on which housing walls preferably extend in a substantially rectangular housing form, wherein, in the corner areas, the housing form comprises hollow chambers, which extend outwardly on the housing walls.

9. The signaling device according to claim 8, wherein fastening links, which preferably extend in the plane of the housing bottom between the hollow chambers, are disposed on the outer side of the base housing body, wherein at least one hole is placed into the fastening links.

10. The signaling device according to claim 8 or 9, wherein perforations are placed into the housing bottom, wherein the perforations are formed for the optional removal for forming holes, so as to fasten the signaling device on the accommodating body by means of fastening means, said fastening means being capable of being guided through the holes.

11. The signaling device according to claim 1, wherein the signaling device is embodied for the combined emitting of acoustic and visual signals, wherein the signaling device comprises a lighting unit, which is preferably disposed on the base housing body and which is electrically connected in particular to the line connection means.

12. The signaling device according to claim 1, wherein a guide arrangement is provided between the base housing body and the upper housing part, by means of which the upper housing part is guided when joining the upper housing part to the base housing body.

13. The signaling device according to claim 12, wherein the guide arrangement comprises at least one guide spring and at least one guide groove, wherein the guide spring is inserted into the assigned guide groove by joining the upper housing part to the base housing body.

14. The signaling device according to claim 12 or 13, wherein the guide arrangement comprises a plurality of guide springs and a plurality of guide grooves, which are respectively assigned to each other, wherein at least one guide spring comprising a differing geometry is assigned to at least one guide groove comprising a correspondingly differing geometry, so that the upper housing part can be disposed on the base housing body only when the guide spring comprising the differing geometry is joined with the guide groove comprising the differing geometry.

15. The signaling device according to claim 1, wherein the base housing body comprises a depth and wherein the upper housing part comprises a depth, wherein, in particular the upper housing part in the assembled state on the base housing body projects into the base housing body, in particular wherein the ratio of the depth of the base housing body to the depth of the upper housing part has a value of between 1.0 and 4.4, preferably between 1.4 and 4.1, and particularly preferably between 1.45 and 3.0.

* * * * *